United States Patent [19]

Dózsa et al.

[11] Patent Number: 4,548,460

[45] Date of Patent: Oct. 22, 1985

[54] ANTI-SLIP FIXING DEVICE FOR RIBBON-TYPE STRAPS AND CABLES

[75] Inventors: László Dózsa; Jenó Pelencei; Gyula Somodi, all of Budapest, Hungary

[73] Assignee: Telefongyar, Budapest, Hungary

[21] Appl. No.: 604,430

[22] PCT Filed: Jul. 3, 1981

[86] PCT No.: PCT/HU81/00029

§ 371 Date: Jan. 26, 1982

§ 102(e) Date: Jan. 26, 1982

[87] PCT Pub. No.: WO82/00384

PCT Pub. Date: Feb. 4, 1982

Related U.S. Application Data

[63] Continuation of Ser. No. 354,093, Jan. 26, 1982, abandoned.

[30] Foreign Application Priority Data

Jul. 12, 1980 [HU] Hungary ..... 1753/80

[51] Int. Cl.[4] ..... H01R 13/58

[52] U.S. Cl. ..... 339/107; 339/17 F; 339/105

[58] Field of Search ..... 339/17 F, 176 MF, 97 P, 339/99 R, 103 M, 103 R, 107, 105; 24/136 R, 525, 614

[56] References Cited

U.S. PATENT DOCUMENTS

| | | | |
|---|---|---|---|
| 3,713,073 | 1/1973 | Narozny et al. | 339/17 F |
| 3,879,099 | 4/1975 | Shaffer | 339/176 MF X |
| 4,225,205 | 9/1980 | Sinclair et al. | 339/103 M X |
| 4,269,466 | 5/1981 | Huber | 339/107 |
| 4,323,295 | 4/1982 | Davis | 339/107 |

*Primary Examiner*—Eugene F. Desmond

*Attorney, Agent, or Firm*—Handal & Morofsky

[57] ABSTRACT

The invention relates to an anti-slip fixing device particularly for the purpose of fixing ribbon-type straps, cables in ribbon cable connecting assembly units. In the arrangement according to the invention, the fixing elements are realized by cylindrical pins, which form surfaces according to orthogonal trajectories on the surface of the ribbon cable, in which the friction arising against the pulling force is of quadratic magnitude compared to application of the continuous, linear fixing gate.

11 Claims, 20 Drawing Figures

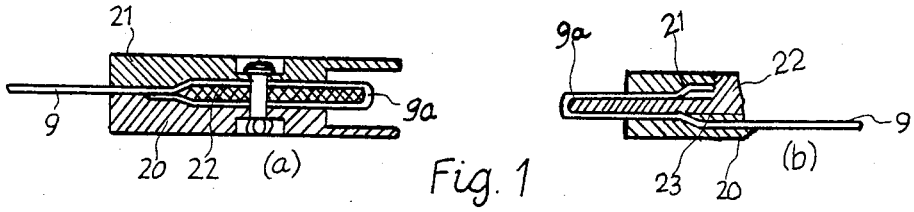
Fig. 1
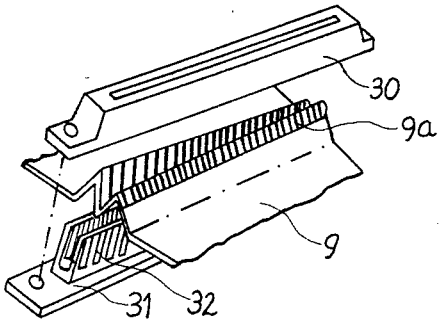
Fig. 2
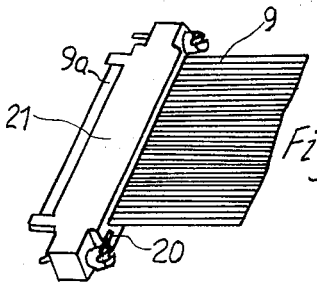
Fig. 3a
Fig. 3b
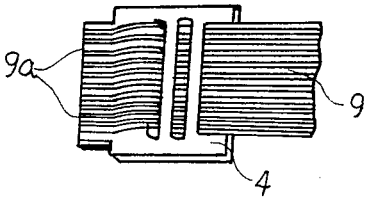
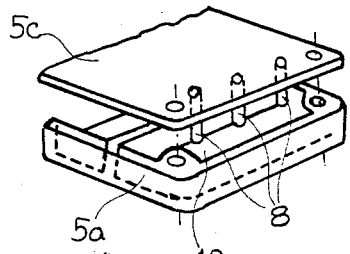
Fig. 4a
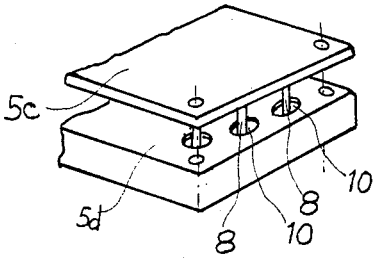
Fig. 4b
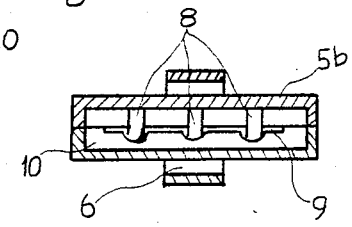
Fig. 5

Fig. 6-(a)
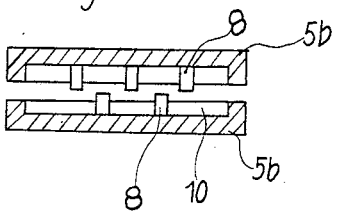
Fig. 6-(b)
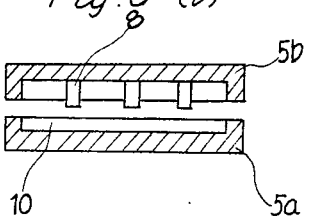
Fig. 6-(c)
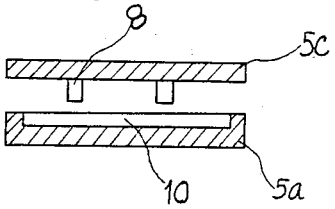
Fig. 6-(d)
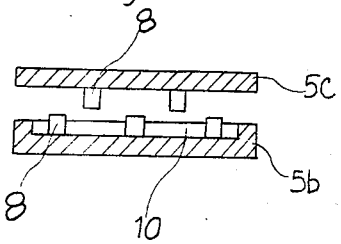
Fig. 6-(e)
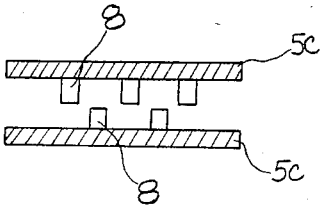
Fig. 6-(f)
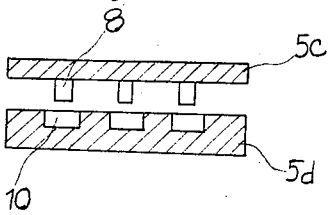

Fig. 7-(a)
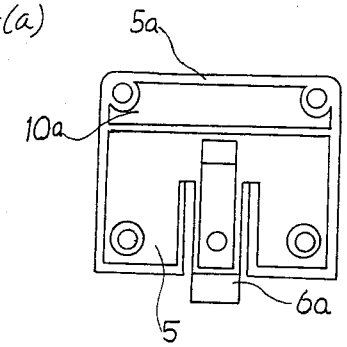
Fig. 7-(b)
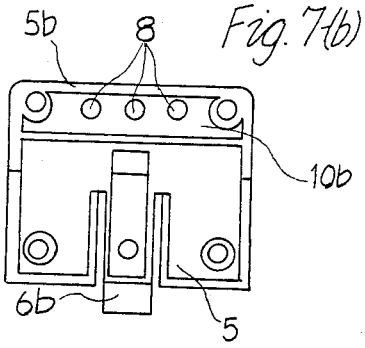
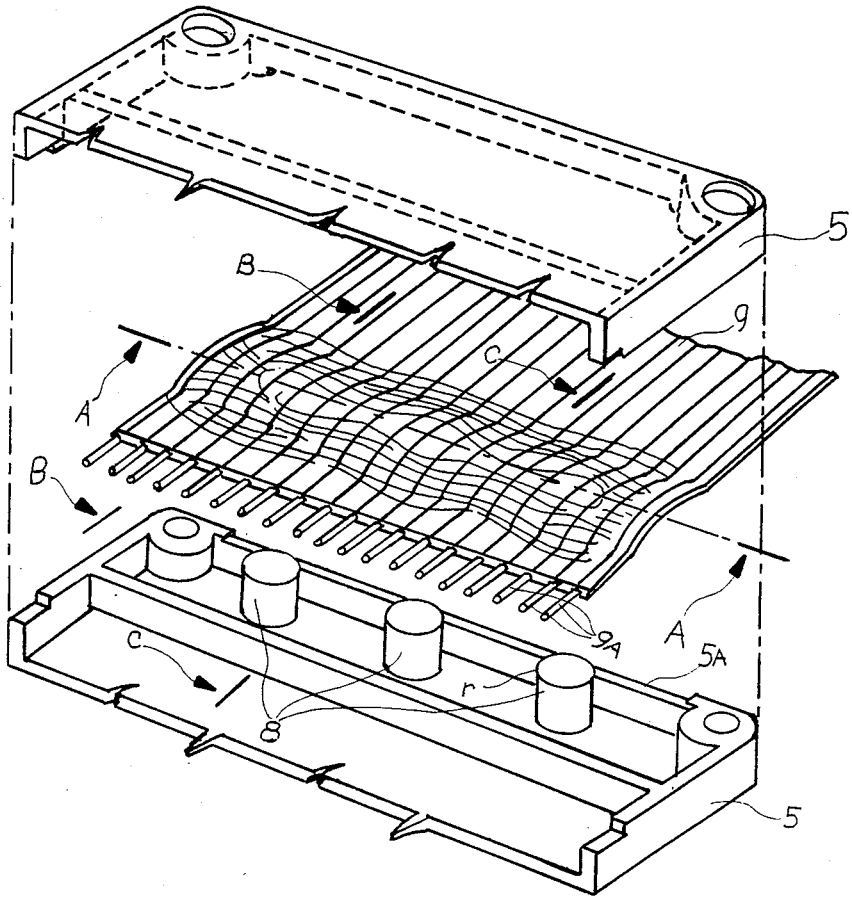
Fig. 8

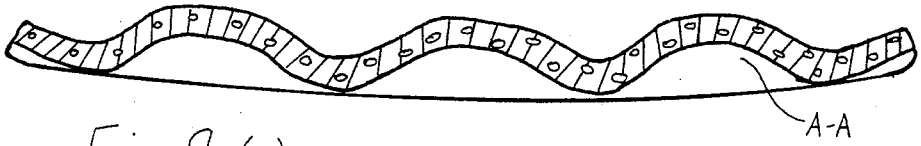
Fig. 9-(a)
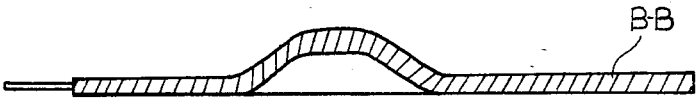
Fig. 9-(b)
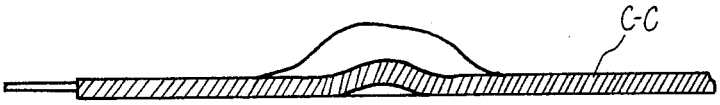
Fig. 9-(c)
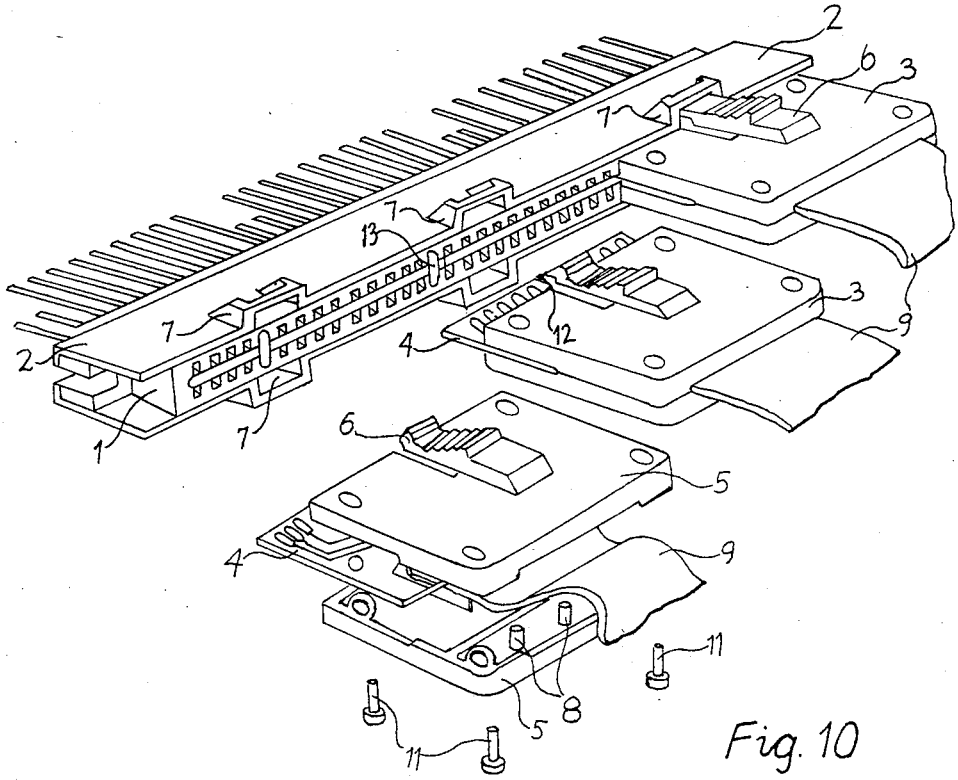
Fig. 10

ANTI-SLIP FIXING DEVICE FOR RIBBON-TYPE STRAPS AND CABLES

This application is a continuation of Ser. No. 354,093, filed Jan. 26, 1982 and now abandoned.

TECHNICAL FIELD

The invention relates to an anti-slip device for ribbon-type straps and cables, particularly in assembly units connected with ribbon cables.

BACKGROUND ART

Such cable arrangement is understood by ribbon cable, in which the electrically conductive metal is a metal wire of circular cross section, or flattened metal ribbon, or optical lead wires laid parallel with and next to each other are arranged with continuous insulation, and the distances of the lead wires measured from each other are characterized in that they generally concur with the raster spacing of the plates with printed wiring.

Use of the ribbon cables is preferred especially in those apparatuses, where the cable follows the shape of the structure, or the components may shift within an apparatus or equipment. The flexible, multi-wire ribbon cables are mostly used with couplings fitted to the two ends. The couplings are required to fix the band shape of the ribbon cables without slipping and to prevent the mechanical joints of the thin wires of low strength from breaking off the printed circuit plate, or from its apparatus.

DISCLOSURE OF INVENTION

The invention relates to such ribbon cable fixing, anti-slip device, which prevents loosening or breakage of the mechanical joints arising as a result of the slip, by fixing the ribbon cable without capable of slipping, and the apparatus itself consists of less components than the apparatuses known so far, its production is simpler, assmebly easier and no failure will occur when the cables are connected up or pulled out of the coupling.

Thus the invention is such a fixing device which prevents the slip and for this purpose it forms the multitude of concentric circles as orthogonal trajectories on the surface of ribbon-type straps, particularly on the surface of ribbon cables, and it consists suitably of two half pieces. A fixing chamber is on one of the half pieces and fixing pins extend from the other half piece, fitting to the cavity of the fixing chamber when assembled.

The invention is explained by way of the enclosed drawings and the presently used general types are introduced.

BRIEF DESCRIPTION OF DRAWINGS

FIGS. 1(*a*) and (*b*) illustrates a prior art connecting assembly unit, in which the ribbon cable is folded back between the two main parts of the device enframing a distance piece.

FIG. 2 illustrates a prior art assembly unit in which two ribbon cable couplings are assembled.

FIG. 3 demonstrates a prior art, simple interlaced type coupling unit.

FIGS. 4(*a*) and (*b*); FIG. 5 and FIGS. 6(*a*), (*b*), (*c*), (*d*), (*e*) and (*f*) are general arrangements of the solution according to the invention.

FIGS. 7(*a*) and (*b*) is suitable embodiment of the invention.

FIG. 8 is embodiment according to the invention including the ribbon cable and illustrates the orthogonal trajectories arising from the surface of the ribbon cable.

FIGS. 9(*a*), (*b*) and (*c*) is section of the ribbon cable, formed by the fixing pins and its position can be interpreted according to the intersecting planes marked in FIG. 8.

FIG. 10 illustrates the suitable connection of the assembly units according to the invention.

BEST MODE OF CARRYING OUT THE INVENTION

In the generally used embodiment according to FIGS. 1(*a*) and (*b*), the ribbon cable is marked with reference number 9, the ribbon cable 9 folded back for the contacting part is marked with 9*a*, the two half pieces are 20, 21, the distance piece 22, onto which the ribbon cable 9 is folded back and thus forming the contacting part. Similar clamping is used by the United Kingdom Pat. No. 1 317 263 and U.S. Pat. No. 3,813,634.

FIG. 2 illustrates the general view of such ribbon cable coupling which demonstrates the connection of two, separate ribbon cables. In the order of the reference numbers the ribbon cable is 9, the ribbon cable end formed for the contact is 9*a*, the two half pieces encasing the end of the ribbon cable are 20 and 21, and the half pieces of the other ribbon cable are marked with 30, 31, 32. Such solution is shown in the West German patent disclosure No. 1 808 453.

FIGS. 3(*a*) and (*b*) shows the generally known, simple interlaced type, where the ribbon cable is 9, end of the ribbon cable formed for contact is 9*a*, the anti-slip fixing device formed as a single piece is marked with reference number 4. Similar devices are shown in the U.S. Pat. Nos. 3,823,443 and 4,038,726, furthermore in West German Pat. No. 1 202 860, where the continuity of the ribbon cable plane is broken by parallel protruding elements preventing the slip by stretching, and fixing it in the required position. Slip occurs in any of the mentioned solutions during acutation. In the interest of safer fixing such solution is known which employs multiple back-folding, as shown in West German Pat. No. 2 018 935, and such solution is also known, according to which the ribbon cable laid in a trough is fixed in anti-slip position by a separate clamping element and the trough is fitted with separate fixing pins to the circuit plate, bringing about the outlet of the ribbon cable. Thus each of the mentioned examples attempts the clamping of the ribbon cable with use of linear deflecting gate, which is perpendicular to the lead wires of the ribbon cable. The ribbon cable suffers continuous bending during its pull-out, and connecting-up activities, but at the same time the previously bent parts are straightened, and the undesirable slip occurs resulting in breakage of the mechanical joint of the lead wires of the ribbon cable after outlet of the circuit plate.

The invention prevents the slip by realizing the recognition, that in place of the linear fixing gate—known according to the present state of the technique—pins are used as fixing elements. When the ribbon cable is fixed with pins, a hollow formation occurs on the surface of the ribbon cable corresponding to the locations of the pins, the formation of which can be interpreted according to the deep-drawing process. In this case not only the force necessary for the bending and straightening will arise when the ribbon is pulled through, as in case of the linear fixing gate, but greater force effects valid for the deep-drawing will arise. This phenomenon is shown in FIG. 8.

The half pieces 5 are the mirror images of each other, the fixing pins 8 are arranged in one of the half pieces, while the ribbon cable 9 is pressed into the other half at the height determined by pins 8.

In the arrangement according to the invention, geometry of the shape transformation developed in the ribbon cable follow the shape of the orthogonal trajectories. The related literature can be found in Volume IV. of the Technical Mathematics For Engineers authored by Dr. Gyula Gaspar, Ivan Raisz and Jozsef Salanki, in chapters titled as differential equations and geometric demonstration on pages 16–22 (published by the Publishing Agency of Schook Books, in 1969, Budapest, Hungary, under Reference No. OMKDK C-88644/4), furthermore, on pages 59–64 of volume VI of the Book "Mathematics For Engineers"; in chapter entitled the two-dimensional vector fields (authored by Dr. Sandor Gaspar and Dr. Zoltan Szarka and published by the Publishing Agency of School Books, in 1969, Budapest, Hungary, under Reference No. OMKDK 88647/6).

Thus the invention realized such fixing device as the anti-slip assembly unit of ribbon cable, which—for the purpose of fastening—forms orthogonal trajectories and suitably consists of two half pieces 5*a*, 5*b* or pairs shown by diagrams (a)–(f) in FIG. 6 as variations of half pieces 5*c*, 5*d*, furthermore of circular or elliptic cross sectional fixing pins 8 or fixing holes 10 and some kind of conventional fastening element 11, holding the two half pieces together and bored blocks or holes 11*a* formed for this purpose and rigid or flexible fixing elements 6*a*, 6*b* for the purpose of further fastening. Each of the two half pieces 5*b*, 5*b* in diagram (a) of FIG. 6 has fixing chamber and fixing pins 8, or fixing pins 8 are in the chamber of one half piece as in diagram (b) fitted with a pinless chamber 5*a* as also in (c). Fixing pins 8 are in the flanged chamber 5*b* of one half piece and along the plane of the other half piece 5*c* fitted to it as shown in (d). Fixing pins 8 are along the plane of both half pieces 5*c*, 5*c* fitted to each other as shown in (c), or bored holes 10 are in the plane of one half piece 5*d* fitted to the fixing pins 8 formed from the plane of the other half piece 5*c* as shown in (f) of FIG. 6.

Fixing chamber is called the cavity 10, formed according to 10, 10*a*, 10*b* surrounded with flange, or recessed in plane 5*d*.

However, the anti-slip fixing is realized even when the fixing pins protrude from the plane as shown in diagram (e) of FIG. 6.

Position of the fixing pins in the half pieces is possible in a line along the plane perpendicular to the half piece, or parallel in several planes and several lines, but at joining the two half pieces the projections of the pins in diagrams (a), (d), and (e) of FIG. 6 according to the longitudinal axis are free from penetration, are not in contact with each other. Furthermore it is possible to have a cavity formed in the fixing chamber opposite the pins in the arrangement according to diagram (f) of FIG. 6, and the perpendicular projections of the pins of one half piece and the cavities of the other half piece coincide with each other.

Shape of the fixing pins 8 is circular, or elliptic, at which the difference between the small and large axes is less than half of the small axis. The rounding radius r of the fixing surface of the pins, i.e. that of the intersection edge of the cylinder jacket and flat surface is suitably less than 0.1 mm. Height of the fixing pins conforms to the height of flanges 5*a*, 5*b* and height of the flanges conforms to the mechanical parameters of the ribbon cable 9, which is not subject of this invention. Sum of the pin(s) diameters is greater than $\frac{1}{8}$ of the ribbon width. The invention is based partly on this recognition. This is verified in Volume V of the "Mechanical and Electrical Engineer Manual" by Pattantyus in connection with bending on page 288 and deep-drawing on page 306.

The fixing element used according to the invention is pin-like, as illustrated and explained under item No. 8. The earlier used fixing elements are of gate type, shown in FIGS. 1–3, which may be regarded as the line of continuous pins.

When the half pieces according to FIGS. 7 and 8 are joined, the pin-type fixing elements press the cable with greater force than the ribbon, as if a linear fixing gate were formed for this purpose. The greater pressing force arises higher frictional force on the contacting surfaces against pull-out, thus the anti-slip grip means considerable relief for the soldered wires of the ribbon cable.

In addition to the friction force between the clamping half pieces, a deformation resistance arises in the ribbon against pull-out of the ribbon. In case of using linear fixing gate, the ribbon suffers continuous bending, but straightening of the bent parts takes place just as well.

In case of pin-like fixing element, continuous "lopsided" deep-drawing is brought about at passage of the ribbon, because the side of the pin-like fixing element opposite the pulling direction continuously shapes the ribbon 9. According to the quoted literature, the force requirement of the deep-drawing starting from the stationary state is higher than that of the bending, consequently the force requirement for pulling through the pin-like fixing element is higher than that of the process performed on the fixing gate.

The clamping half pieces developed with pin-like fixing element as shown in FIG. 8,—due to the higher friction force arising from the greater pressure force and higher deformation resistance arising from the pin-like construction—ensure a safer anti-slip fixing of the ribbon against the pulling force acting on the ribbon, than the linear fixing gate. Further advantage is that the fixing against the pulling force acting on the ribbon in any direction along the plane of the ribbon is more effective, because the intersection points of ribbon 9 form curvilinear section according to FIGS. 9(*a*), (*b*) and (*c*). The sections containing the symmetry axis of the pin-like 8 guiding element are shown in FIG. 9, where the sections are marked the same way, as the surface of the ribbon cable 9, shown in FIG. 8, furthermore the spatial deformations of ribbon cable 9 are comparable with the directions of the fixing pins 8. From the relationship related to deep-drawing (bending in the quoted literature it is apparent, that ratio of deep-drawing—bending will be greater than 1, if 8-times the pin diameter d) ribbon width b is higher than 1. From the relationship it follows that diameter d of the fixing pin 8 must be greater than $\frac{1}{8}$ of the ribbon width b. Thus in every case when diameter d of the pin-like fixing element is greater than $\frac{1}{8}$ of the ribbon width, a greater force is necessary for fixing the ribbon, than in case of the gate-like fixing element.

When for constructional reasons diameter d of the pin-like fixing element can not be increased to the ribbon width b to such extent, that d should remain greater than $\frac{1}{8}$b, then it is necessary to increase the number of pin-like fixing elements until the condition of d being greater than b/8n is fulfilled, where n=number of pin-like fixing elements.

From the suitable embodiment of the solution according to the invention shown in FIGS. 7(*a*) and (*b*), it is recognizable, that the invention can be realized by the formation of a single piece, it requires less number of components, than other similar solutions.

Through the pin-like fixing elements fixing of the ribbon cable is slip-proof, outlet of the lead wires coincides with the spacing of the strip used for connection of the printed circuit plates, the wiring can be mechanically carried out with conventional method without interruption of the wiring process.

The connecting assembly unit as fixing device relieves the electric lead wires, their soldering spots and soldered guide foils of the printed circuits.

FIG. 10 shows a suitable arrangement of the embodiment, whereby the time of connection is considerably reduced, because the coupling assembly realized with the invention includes the ribbon cable 9 and connecting circuit plate 4, which can be placed into the main coupling 1 of the assembly with a simple movement, furthermore the conventional flexible snap-lug 6 is applicable on the connecting assembly unit realizing the invention, which is connected with cavity 7 of the main coupling strip.

What we claim is:

1. Anti-slip clamping device for fixing a ribbon-type cable against slipping, comprising two half pieces, fixing pins formed at least in one half piece, at least one fixing chamber formed in at least one of said half pieces for mating with the pins of the other half piece, wherein said pins have a height providing a positive three dimensional locking action on said cable without said pins penetrating into said cable, thereby eliminating the need for locking holes and a fastening means securing the two half pieces together when clamped, said pins and holes being dimensioned according to the following relations:

$$d > b/8n$$

wherein:

d—diameter of the pin;

b—width of the cable;

n—number of the pins.

2. The clamping device as claimed in claim 1, wherein each of said two half pieces comprises at least one fixing chamber and at least one fixing pin.

3. The clamping device as claimed in claim 1, wherein one of said half pieces comprises said fixing pins and the other of said half pieces comprises a pinless fixing chamber.

4. The clamping device as claimed in claim 1, wherein each of said half pieces comprises fixing pins.

5. The clamping device as claimed in claim 1, wherein said fixing chamber comprises a single recess formed in one of said half pieces.

6. The clamping device as claimed in claim 1, wherein said fixing chamber comprises a plurality of holes bored into one of said half pieces.

7. The clamping device as claimed in claim 1, wherein said fixing chamber is a recess formed with a flange.

8. The clamping device as claimed in claim 4, wherein said pins of said half pieces are arranged in a single row.

9. The clamping device as claimed in claim 7, wherein said pins are spaced from each other and from said flange on equal distances, said distances being larger than the diameter of said pins.

10. The clamping device as claimed in claim 7, wherein said flange protrudes above the height of said pins.

11. The clamping device as claimed in claim 10, wherein said pins have a tip radius (r) of curvature which is smaller than 0.1 mm.

* * * * *